US005454120A

United States Patent [19]

Rowlands

[11] Patent Number: 5,454,120

[45] Date of Patent: Oct. 3, 1995

[54] BALL CAP WITH REPLACEABLE PENNANT PANELS

[76] Inventor: Timothy W. Rowlands, 28316 Kendallwood, Farmington Hills, Mich. 48334

[21] Appl. No.: 231,814

[22] Filed: Apr. 25, 1994

[51] Int. Cl.[6] ..... A42B 1/24

[52] U.S. Cl. ..... 2/195.1; 2/209.12; 40/329

[58] Field of Search ..... 2/171, 171.1, 175.1, 2/175.3, 195.1, 209.11, 209.12, 209.13, 909, 918; 40/329

[56] References Cited

U.S. PATENT DOCUMENTS 2,749,555 6/1956 Oliveira ..... 40/329

5,253,368 10/1993 Blake ..... 2/209.13

5,359,733 11/1994 Brannon et al. ..... 2/918

*Primary Examiner*—Clifford D. Crowder

*Assistant Examiner*—Diana L. Biefeld

*Attorney, Agent, or Firm*—John R. Benefiel

[57] ABSTRACT

A baseball cap having one or more pennant panels attached to the cap crown bearing a graphic of a particular theme such as being emblazoned with colors and marked with a sports team identifier to resemble miniature pennants. The pennant panels are detachably affixed to allow ready replacement with pennant panels having other graphic displays.

5 Claims, 1 Drawing Sheet

BALL CAP WITH REPLACEABLE PENNANT PANELS

BACKGROUND OF THE INVENTION

1. Field of the Invention

This invention concerns hats and more particularly baseball caps currently widely worn as a sportswear item, particularly at sporting events.

1. Background Art

The perennial high interest in spectator sports has led to a proliferation of ways to display team names, logos, slogans, rallying phrases, etc., as by imprinting the same on clothing items, and on useful articles such as drinking glasses, ash trays, and the like. This is also true with respect to other mass spectator events such as rock concerts such as performer promotions with T-shirts.

It would be advantageous if the owner of a baseball cap could be provided with a suitable attachable display suited for a particular event.

It has heretofore been proposed to provide replaceable patches on ball caps, the patches bearing sports theme graphics, as described in U.S. Pat. No. 4,776,043 issued on Oct. 11, 1988 for a "Hat and Logo".

U.S. Pat. No. 5,253,368 issued on Oct. 19, 1993, for a "Cap with Erasable Billboard" describes a cap with a writing surface enabling various team names to be written on the surface.

These prior art caps do not provide presentation of the graphics in an eyecatching manner, which is highly desirable to sports and rock concert fans.

Accordingly, it is an object of the present invention to provide a cap having a display of graphic material in a highly attractive and eye catching manner.

SUMMARY OF THE INVENTION

The above object is achieved by providing one or more generally triangularly shaped "pennant" panels adapted to overlie or replace one of the triangularly, shaped panels forming the cap crown portion. A sports team name and logo or other similar graphic material is marked thereon and oriented in a direction extending from the base edge to the tip of the pennant panel. The team colors are also preferably emblazoned thereon to resemble a miniature pennant.

The imprinted pennant panels are preferably detachably mounted on the crown of the cap in order to allow replacement of each pennant panel with any of various other pennant panels bearing graphics of other themes.

The detachable mounting can take the form of a loop attached to the tip of the pennant panel which can be fit over the button at the top of the cap crown, with the lower base edge secured with clips to the rim of the crown, or with VELCRO (TM) patches.

DETAILED DESCRIPTION

Figure 1:
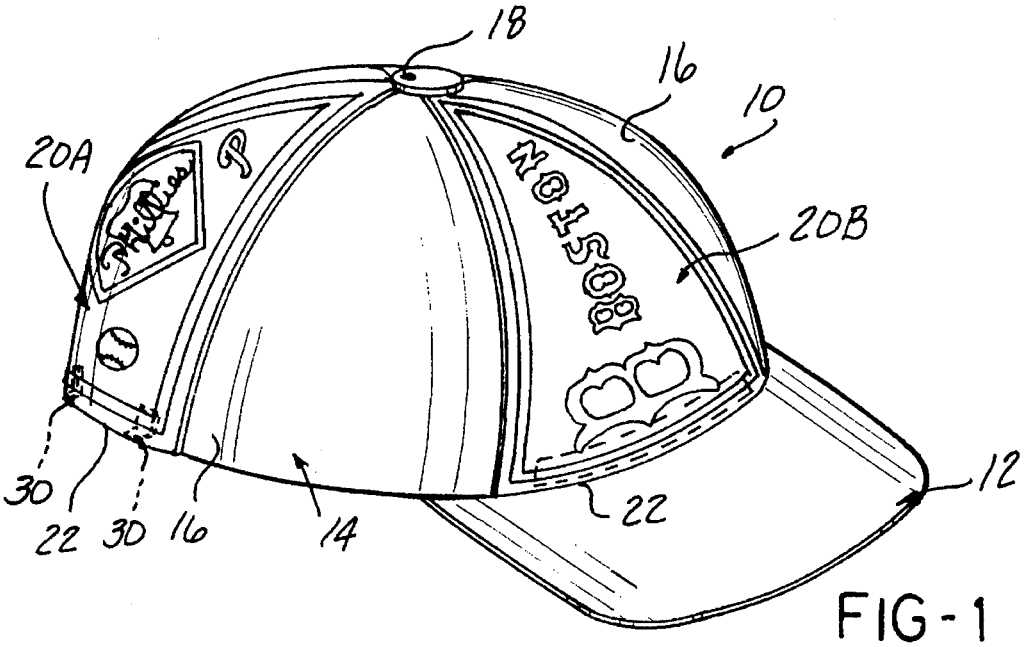
FIG. 1 is a perspective view of a baseball cap having two pennant panels affixed thereto in accordance with the present invention.

In the following detailed description, certain specific terminology will be employed for the sake of clarity and a particular embodiment described in accordance with the requirements of 35 USC 112, but it is to be understood that the same is not intended to be limiting inasmuch as the invention is capable of taking many forms and variations within the scope of the appended claims.

Referring to the Drawings, the invention comprises a particular adornment of a baseball cap 10, which has a visor 12 projecting from a crown portion 14 forming a dome shape adapted to be worn atop a person's head. Typically, the crown 14 of such ball caps is constructed of generally triangular, sewn together fabric panels 16 forming the dome shape. The crown panels 16 converge at the peak of the crown.

A fabric covered button 18 is usually sewn in at the peak.

According to the concept of the present invention, the crown 14 has one or more pennant panels 20 installed over (or replacing) one of the crown panel 16.

The pennant panels 20A, 20B are each bear a graphic such as with a sports theme, as by being imprinted, embroidered, silk screened, etc. This graphic could comprise team logos and/or names associated with the sports team. The lettering is oriented to be read in the general direction from the base edge 22 at the crown rim to the convergent opposite tip, as is customary with full sized sports pennants.

The pennant panels 20 are also preferably emblazoned with a sports team colors or other colorings, which preferably contrast with the color of the remaining crown panels 16. This creates an eyecatching colorful display, particularly when a number of contrasting or different pennant panels 20A, 20B are employed, producing a beachball appearance.

The pennant panels 20A, 20B are preferably readily mountable and removable to allow other pennants having markings relating to various other sports themes to be installed as for wearing at a particular sporting or other event.

Figure 2:
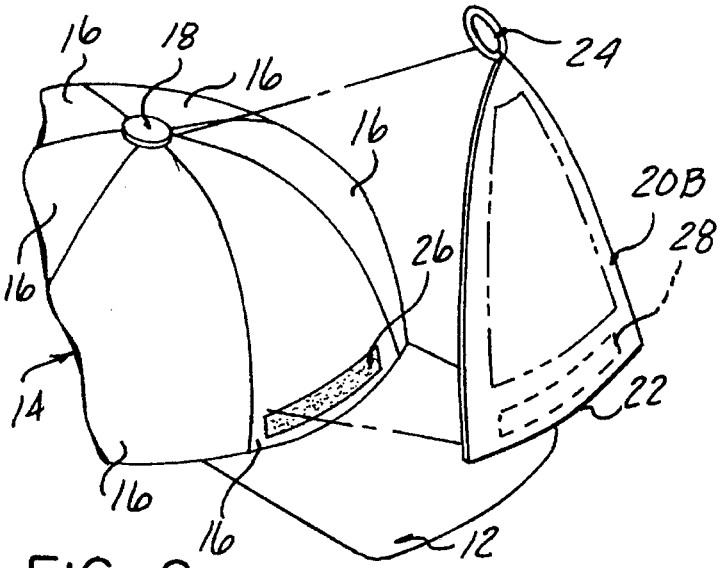
FIG. 2 is a fragmentary exploded perspective view showing detachment of a pennant display panel.
Figure 3:
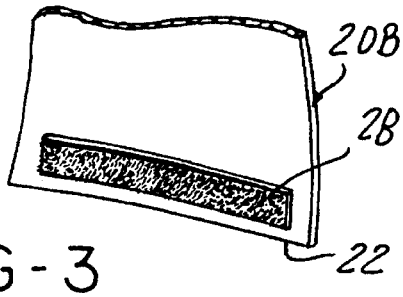
FIG. 3 is a fragmentary rear perspective view of a pennant panel showing the form of mounting of the pennant panel of FIG. 2.

FIG. 2 illustrates the details of one such mounting particularly suited for the centered forward pennant panel 20B located above the visor 12. A loop 24 is attached at the tip of the panel 20B, configured to be installed over the crown button 18. The loop 24 may be of elastic material to facilitate being held on the button 18.

Mating patches of hook and loop (VELCRO TM) material 26, 28 are installed at the lower edge of the pennant panel 20B and the cap panel 16 to detachably hold the base edge 22 to the crown 14.

Figure 4:
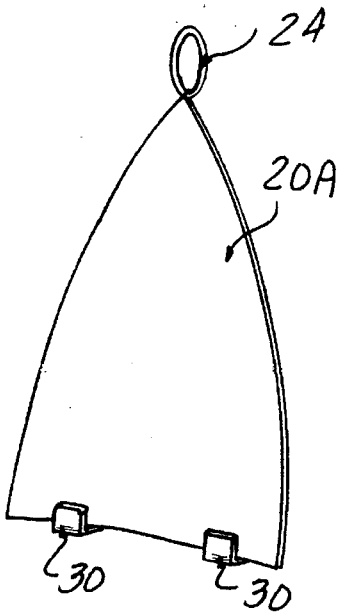
FIG. 4 is a rear perspective view of a single pennant panel, using an alternate mounting of the pennant panel.

Alternatively, clips 30 can be sewn in to the base edge 22, which can be engaged to the crown rim, as shown in FIG. 4.

VELCRO (TM) patches could also be used at either end of the pennant panels 20 instead of the loop 24 to secure the tip of the each pennant panel 20, although the loop and clip method offers the advantage that no marring of the cap's appearance will be evident when the panel 20 is completely removed.

While a sports theme has been specifically described, it should be understood that graphical displays relating to other themes are also contemplated as a possibility, particularly relating to other spectator events such as rock concerts.

I claim:

1. A baseball cap comprising:

a crown portion constructed of a plurality of generally triangular panels sewn together to form a dome shape adapted to be worn on a person's head;

each of said crown portion panels converging at a peak of said crown portion;

a button at said peak of said crown portion;

a visor projecting from a rim of said crown portion; and, a generally triangular pennant panel on said crown portion overlying said crown portion and detachably mounted thereto, said pennant panel having a pointed end extending to said peak of said crown portion, said pennant panel having a graphic marking oriented in a direction from a base edge at the rim of said crown portion to said pointed end at said crown portion peak, whereby a miniature pennant is suggested;

said pennant panel formed with a loop at said pointed end, said pennant panel loop adapted to be hooked over said button at the peak of said crown portion to be held thereby; and, further including attachment means for detachably attaching said base edge of said pennant panel to said crown portion at the rim thereof.

2. The baseball cap of claim 1 wherein said attachment means comprises one or more clips affixed to each pennant panel base edge and said crown rim.

3. The baseball cap of claim 1 wherein said attachment means comprises hook and loop patches affixed adjacent each pennant panel base edge and said crown adjacent said crown rim.

4. The baseball cap of claim 1 wherein each of said pennant panels is emblazoned with a sports team colors and said graphic comprises a sports team identifier to resemble a miniature team pennant.

5. The baseball cap according to claim 1 wherein said one or more pennant panels are of a color contrasting with the color of said remaining crown panels.

* * * * *